United States Patent [19]

Michaelsen et al.

[11] Patent Number: 4,895,479

[45] Date of Patent: Jan. 23, 1990

[54] LIFT FOR WATERCRAFT

[75] Inventors: Christopher J. Michaelsen; Jack Uchida, both of Seattle, Wash.

[73] Assignee: Nyman Pile Driving, Inc., Issaquah, Wash.

[21] Appl. No.: 133,762

[22] Filed: Dec. 16, 1987

[51] Int. Cl.[4] ..... B63C 3/06

[52] U.S. Cl. ..... 405/3; 405/4; 92/165 R; 254/93 R

[58] Field of Search ..... 405/3, 4, 7; 114/44, 114/45, 48; 254/93 R, 124; 92/165 R, 166, 155, 146

[56] References Cited

U.S. PATENT DOCUMENTS

| | | | |
|---|---|---|---|
| 2,505,832 | 5/1950 | Lange | 405/3 |
| 2,896,583 | 7/1959 | Stixrood | 254/93 R |
| 2,963,176 | 12/1960 | Smith | 405/3 X |
| 3,021,965 | 2/1962 | Harvey | 405/3 X |
| 4,087,076 | 5/1978 | Getty | 254/93 R |
| 4,211,151 | 7/1980 | Wallischeck | 92/165 R X |
| 4,300,439 | 11/1981 | Degnan et al. | 92/146 |

OTHER PUBLICATIONS

*Aqua Lift Owners Manual,* Colba Industries, Inc., Moses Lake, WA, July 1983.

*Primary Examiner*—Dennis L. Taylor
*Assistant Examiner*—J. Russell McBee
*Attorney, Agent, or Firm*—Ward Brown; Robert W. Beach

[57] ABSTRACT

A stationary rectangular base frame is mounted underwater and supports generally upwardly extending, swingable, parallel links or arms. A lift platform or lift pads are supported at the upper end portions of the arms and, in combination with the base frame and arms, form one or more upright parallelograms. A hydraulic jack is connected extending generally diagonally of the parallelogram arrangement and has a plunger for swinging the arms to translate the lift platform or pads up to remove a watercraft from the water or down to lower the watercraft back into the water.

4 Claims, 4 Drawing Sheets

12
11
10
6
3
7
8
9
16
14
5
22
15
21
10
1
7
8
9
2
6

Fig. 3.
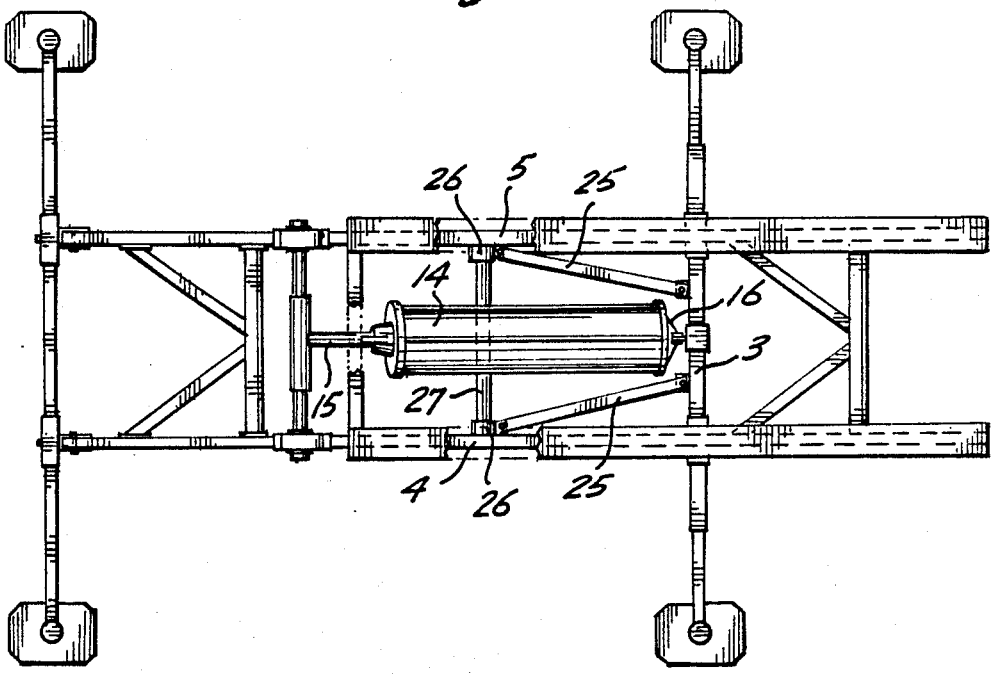
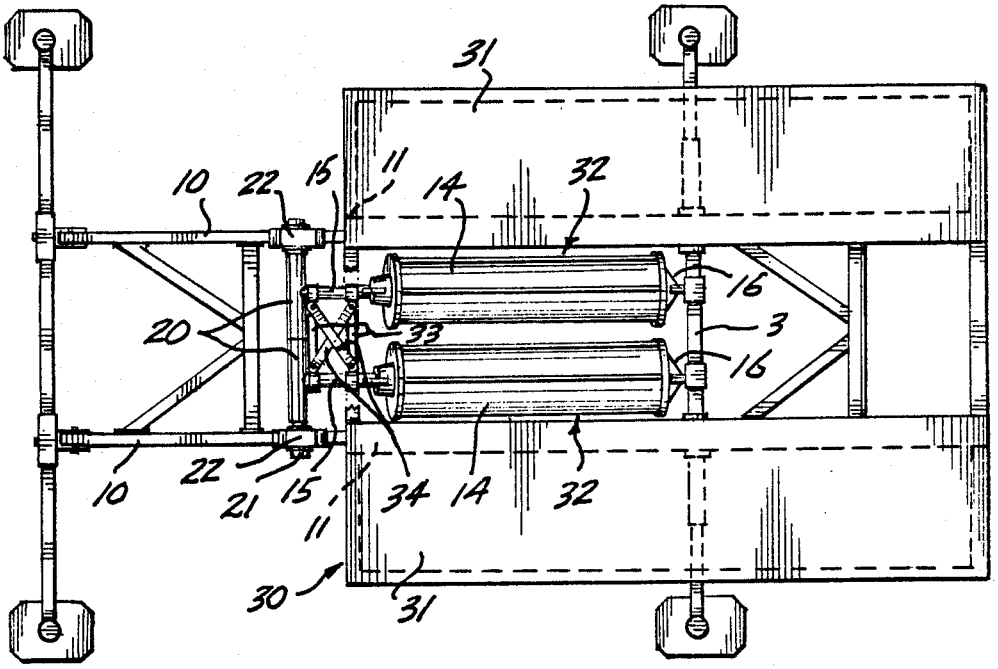
Fig. 4.

LIFT FOR WATERCRAFT

BACKGROUND OF THE INVENTION

1. Field of the Invention

The present invention relates to a lift for marine vessels or watercraft: including boats and seaplanes, to raise the watercraft from the water for storage when not in use.

2. Prior Art

Recognized benefits of storing watercraft out of the water are to provide safe reliable "moorage" so as to prevent the watercraft from hard bumping against adjacent docks or other watercraft or running aground or floating away, to lessen damage by long-term exposure to water, such as by corrosion or electrolysis, or water-carried contaminants, such as oil, to prevent attachment of barnacles or other marine growth, to prevent damage to the watercraft from floating debris, and to maintain the boat or, for example, seaplane floats; water free and of unmarred appearance. Consequently; known lifts have been proposed for boat and seaplane storage, such as adjacent to a dock of a waterfront home. The present invention constitutes an improvement over the known lifts.

SUMMARY OF THE INVENTION

The principal object of the present invention is to provide a novel improved lift for watercraft which lift is of compact and light construction yet sturdy, stable and reliable in use for watercraft of various sizes.

In accordance with the foregoing object, it is an object to provide an improved lift of the type powered by a hydraulic jack and having a novel stationary base frame including a horizontal cross member supporting an end of the jack cylinder and specialized braces for transmitting reaction force to other components of such base frame.

It also is an object to provide such a lift in a form achieving a large amount of vertical motion for a given travel of the plunger of the hydraulic jack without overstressing the stationary and moving components of the lift.

An additional object is to provide such a lift in a form adapted for use of multiple hydraulic jacks in a construction assuring equal internal fluid pressures and synchronous movement of the separately powered jack plungers.

Another object is to provide such a lift with improved safety locking mechanism for retaining the watercraft-supporting components in their raised positions even when fluid pressure in the jack cylinders is relieved.

In accordance with the present invention, the foregoing objects are accomplished by improvements to a lift of the general type having an underwater, horizontal, stationary, rectangular base frame with swingable parallel links or arms pivotally connected at the corners of such frame. The upper end portions of the arms at each side of the frame are connected to a lift platform or pad which engages against the water-craft to be lifted. Conjoint swinging motion of the arms to move the lift platform or pads upward is achieved by a hydraulic jack extending generally diagonally of the parallelogram formed at each side of the lift by a stationary longitudinal beam of the base frame, the swinging arms and the upper lifting platform or pad. The base end portion of the jack cylinder is supported approximately midway between the ends of the rear cross member of the stationary base frame and, consequently, reaction force tending to bend such cross member transversely of its length is applied at that location. Specialized braces are provided at opposite sides of the point of connection of the hydraulic cylinder, such braces being angled outward and forward to the opposite ends of a compression bar extending transversely of the base frame.

The plunger of the hydraulic jack is connected to a cross shaft journaled in brackets carried intermediate the ends of the swinging arms at the forward end of the lift to achieve a large angular swing of the lift arms for a given amount of travel of the plunger, thereby achieving a large amount of vertical motion in a compact construction.

For high load applications, such as for seaplanes, a plurality of hydraulic jacks can be mounted side-by-side. In accordance with the present invention, the plungers of the separate jacks are interconnected such that equal fluid pressures are maintained in the separate jack cylinders and conjoint motion of the plungers is assured, as compared to a "walking" or racking motion of the separate jack plungers.

Improved locking mechanism includes a dog or pawl mounted on the jack cylinder adjacent to the projecting plunger. The pawl has a nose fittable in spaced slots of the plunger and is biased into such slots to lock the lift automatically in subsequent raised positions.

BRIEF DESCRIPTION OF THE DRAWINGS

FIG. 3 is a top plan of the lift of FIGS. 1 and 2 with parts broken away; and FIG. 4 is a top plan of a modified lift in accordance with the present invention.

DETAILED DESCRIPTION

Figure 1:
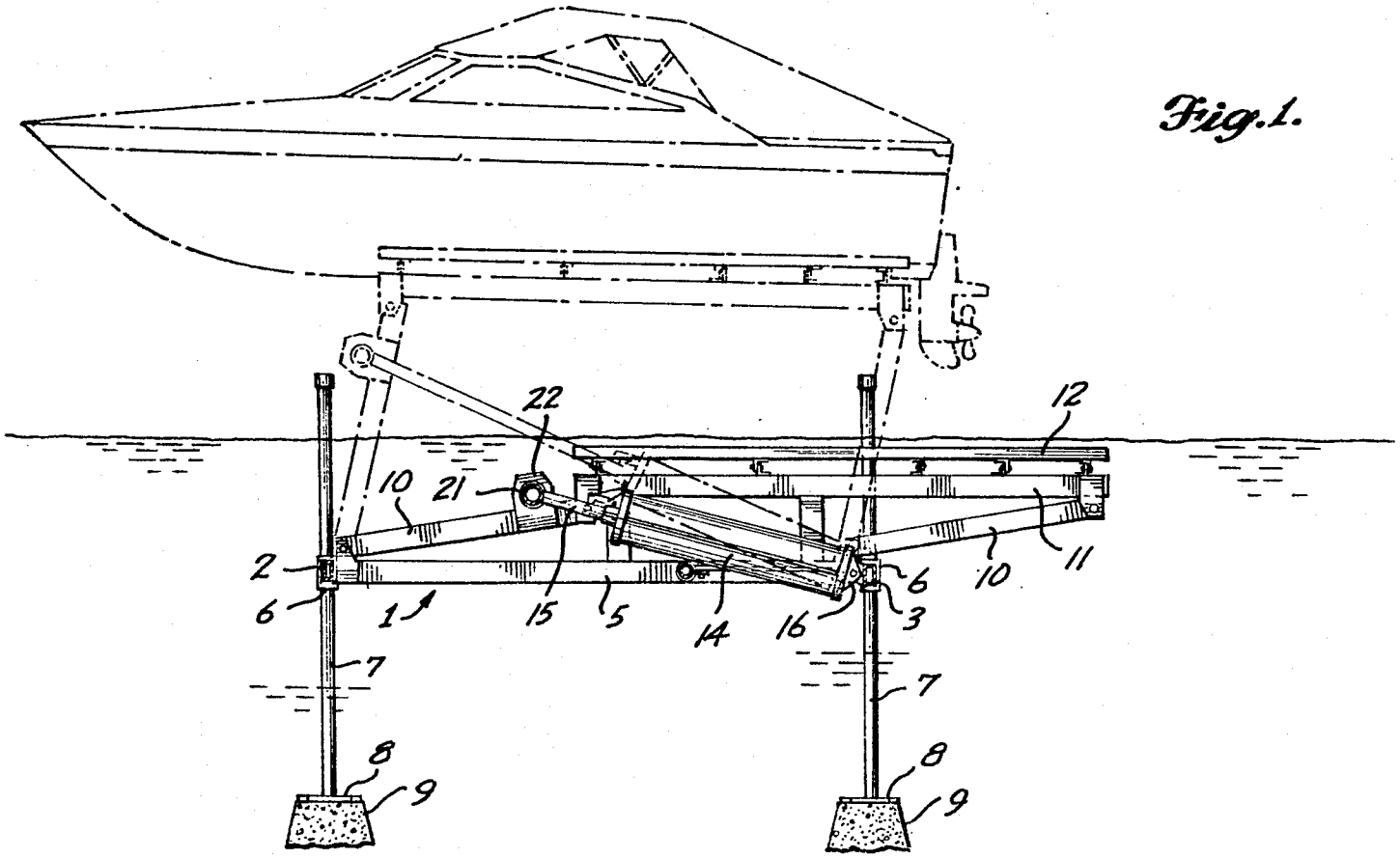
FIG. 1 is a somewhat diagrammatic side elevation of a lift for watercraft in accordance with the present invention, with some parts broken away, illustrating the lowered position of the lift in solid lines and the raised position of the lift in broken lines.
Figure 2:
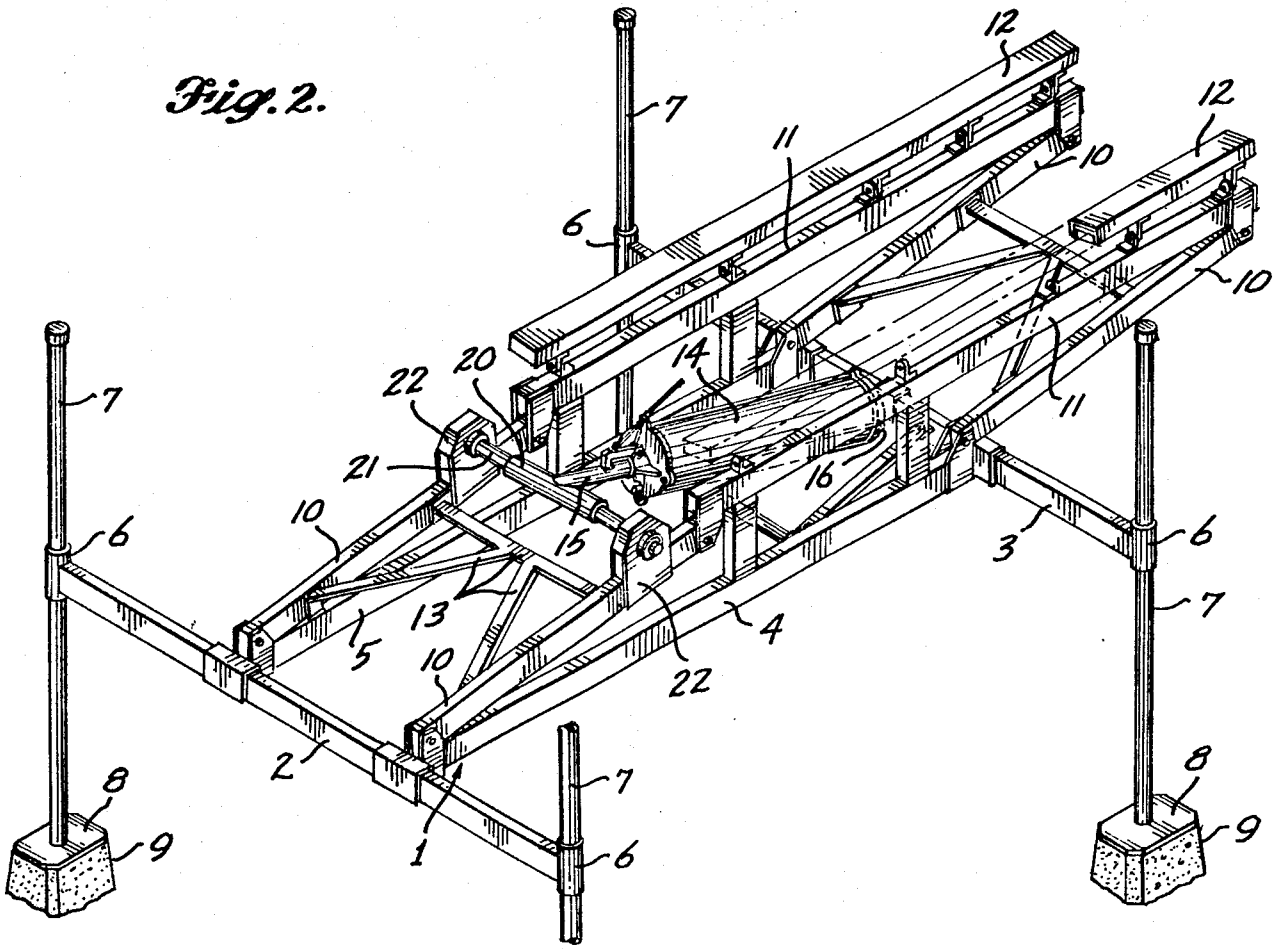
FIG. 2 is a top perspective of the lift of FIG. 1 with parts broken away.

With reference to FIGS. 1 and 2, the lift for watercraft in accordance with the present invention has a generally rectangular, horizontal base frame 1 including front and rear cross members 2 and 3, respectively, supporting longitudinally extending, parallel beams 4 and 5. The opposite ends of each of the cross members 2 and 3 can have collars 6 adjustable along corner posts 7 to position the base frame 1 at a desired location under water. Corner posts 7 can have footpads 8 supported on and secured to piles or foundation blocks 9.

Four parallel swinging links or arms 10 have bottom end portions pivotally connected, respectively, at the four corners of the stationary base frame, namely, at approximately the opposite ends of each of the beams 4 and 5. Arms at the same side of the frame support top horizontal beams 11 which, in turn, carry pads 12 to engage against the watercraft to be lifted such as the hull of the boat shown in broken lines in FIG. 1. The angle of the pads can be adjusted to accommodate different boats or other watercraft. The swinging links or arms 10 at each end of the lift frame are interconnected by angle and cross braces 13.

At each side of the lift, the bottom stationary beam 4 or 5, the front and rear arms 10 connected to it and the top translating beam 11 form a parallelogram. Lifting movement of the translating beams 11 and their pads 12 is achieved by extension of the plunger 15 of a hydraulic jack which extends generally diagonally of the parallelogram. The base end portion 16 of the jack cylinder 14 is pivotally mounted on the rear cross member 3 approximately midway between the ends of such cross member. The plunger 15 of the hydraulic jack is extended by introduction of water under pressure through the base end of the jack cylinder to move an internal piston to which the inner end of the plunger is connected. Such extension of the plunger 15 swings the lift arms 10 from their lowered positions shown in solid lines in FIG. 1 to the raised positions shown in broken lines to hoist a watercraft positioned over the pads 12 out of the water.

As thus far described, the lift is essentially the same as a known prior art lift previously sold by Nyman Pile Driving, Inc. of Issaquah, Washington. In the known lift, however, the free end of the plunger of the hydraulic jack was connected to the top translating beams 11 rearward of their points of pivotal connection to the front swinging arms 10. Elevational movement of the translating beams 11 was necessarily limited by the maximum range of motion of the jack plunger which, in turn, was limited by the length of the jack cylinder. Similarly, the length of the known cylinder was limited to some degree by the dimensions of the stationary base frame.

In accordance with the present invention, the leading free end portion of the jack plunger 15 is connected to a sleeve 20 fitted on a horizontal cross shaft 21. The opposite ends of the shaft 21 are journaled in brackets 22 similar to the attachment of the plunger to the translating beams in the known prior art lift. In the case of the present invention, however, such brackets 22 are mounted on the front swinging links or arms 10 intermediate their points of pivotal connection to the base frame 1 and the upper translating beams 11.

The different location of confection of the hydraulic jack plunger 15 allows a substantially more compact construction and easy adjustment of the elevational movement is achieved. Depending on the desired application, the lengths of the swinging arms 10 can be selected to effect a desired amount of elevational movement for a given swing angle and, as compared to the prior attachment of the plunger to the translating beams, a substantially greater amount of elevational movement is achieved for a given extension of the plunger.

Another improvement of the lift in accordance with the present invention is best described with reference to FIG. 3 which most clearly shows the point of connection of the base end 16 of the jack cylinder 14 to the rear horizontal cross member 3. When the jack plunger 15 is extended, reaction force is applied midway between the ends and transversely of such cross member. In accordance with the present invention; two flat bar braces 25 are provided connected to the rear cross member 3 at opposite sides of the point of connection of the base 16 of the hydraulic cylinder 14. Each flat bar brace 25 extends horizontally forward and outward and has its leading end portion connected to a bracket 26 projecting inward from the inner upright face of the longitudinally extending box beam 4 or 5 at the same side. Each bracket 26 forms an inward-opening cylindrical socket. A straight compression bar or tube 27 extends transversely of the base frame and has its opposite end portions received in such sockets.

Application of reaction force at the base 16 of the hydraulic cylinder during a lifting operation is transmitted as tension of the braces 25 to the brackets 26. The force is applied lengthwise of the braces and has a rearward component transmitted as compression of the rear end portions of the beams 4 and 5. Such force also has an-inward-directed component tending to bow or bend the central portions of beams 4 and 5 toward each other. Inward bowing or bending motion of the brace bars is prevented by the compression tube 27 providing an improved rigidified base frame construction.

For lifting large boats and seaplanes, it may be necessary to provide more than one hydraulic jack. In the known prior art lift, multiple jacks were provided in a construction deleting the jack mounted centrally of the stationary base frame and substituting separate jacks each mounted at the outside of the base frame. In the improved construction shown in FIG. 4, illustrating a top lifting platform 30 having interconnected decks 31 mounted on the translating beams 11 such as for engaging against the floats of a seaplane, two hydraulic jacks 32 are mounted in side-by-side relationship at the inside of the stationary base frame beams. The rear end portion 16 of each cylinder 14 is pivotally secured to the rear cross member 3 and the free end portion of each of the two jack plungers 15 is connected to a sleeve 20 fitted over the shaft 21 having its opposite end portions journaled in the brackets 22. As in the previously described embodiment, such brackets are mounted on the front swinging links or arms 10 intermediate their points of pivotal connection to the bottom base frame beams and the top translating beams, respectively.

An important aspect of the improved construction shown in FIG. 4 is the interconnection of the jack plungers 15 by flat bar cross members 33 and crisscrossed flat bar diagonal bracing 34. The cross members 33 are parallel and spaced lengthwise of the plungers 15. The crisscrossed flat bar braces 34 have their opposite end portions connected to the opposite end portions of such cross members 33. Consequently, movement of the respective plungers other than equal, conjoint movement is prevented which is important even if a common source of fluid under pressure is used for the separate jacks 32. If there is any variation in the internal jack pressures, movement of the plungers is not induced or continued until pressure has equalized. In the absence of the interconnection of the plungers, there can be a tendency for first one and then the other plunger to extend, resulting in a "walking" motion of the two plungers which can tend to rack the frame and be damaging to the close fit of the plungers in the ends of the jack cylinders 14. In other respects the construction of the embodiment shown in FIG. 4 is the same as the construction of the previously described embodiment.

Figure 5:
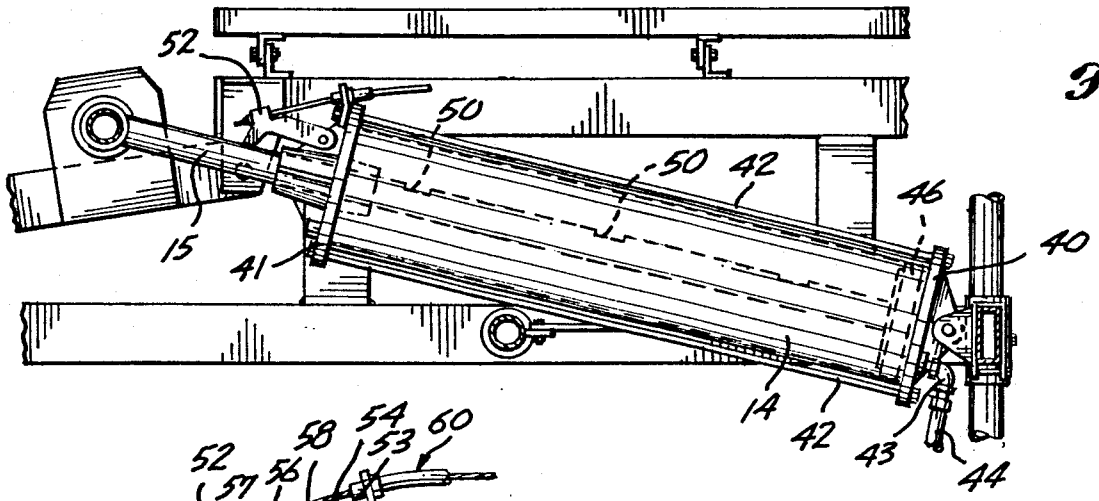
FIG. 5 is an enlarged, fragmentary, side elevation of a component of the lift in accordance with the present invention, namely, the hydraulic jack and its surrounding structure.
Figure 6:
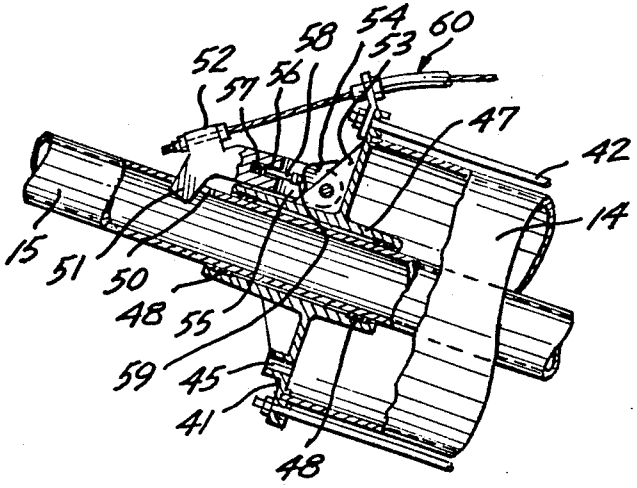
FIG. 6 is a fragmentary, further enlarged, side elevation of the leading end portion of the jack cylinder.

The preferred construction of the hydraulic jacks 32 is best seen in FIGS. 5 and 6. The cylinder 14 of each jack has opposite end plates 40 and 41 clamped together by long bolts 42. The rear end plate 40 has a fitting 43 for connection of the source of fluid under pressure which can be by way of a heavy duty garden hose 44. The front end plate 41 has a vent opening 45 through which water is expelled as the internal piston 46 to which the plunger 15 is connected is moved. The front end plate also has an axially elongated hub 47 with a long cylindrical bore closely receiving the cylindrical plunger 15. As best seen in FIG. 6, rings 48 of slippery plastic material are partially inset in circumferential grooves disposed toward the opposite ends, respectively, of the bore of the hub 47. Such rings can be formed of Teflon material or another slippery plastic. At the outset of use, the plunger 15 is journaled in the rings 48 making little or no contact with the remainder of the inner periphery of the bore of hub 47. Over time, the rings wear so that there is some frictional engagement of the outer periphery of the plunger 15 in the bore of the hub. Particularly when softer metal materials such as aluminum are used, such frictional engagement could greatly lessen the life of the cylinder 14 or at least its front end plate 41. Nevertheless, in the improved construction where the plastic rings are used, it has been found that the slippery plastic material tends to coat the exterior of the plunger and the interior of the hub for a low friction, long life construction.

The improved locking mechanism of the preferred construction in accordance with the present invention also is best seen in FIGS. 5 and 6. The long plunger 15 has regularly spaced through slots 50 for the nose 51 of a dog or pawl 52. In the known construction, a somewhat similar dog or pawl was biased by gravity downward to fit its nose in each consecutive slot 50. A cord could be pulled to release the pawl and permit retraction of the plunger. It could be difficult to detect if the pawl became stuck in its released position, in which case a lifted boat might later be slowly lowered into the water as pressure of liquid in the hydraulic cylinder lessens. In the improved construction, the locking mechanism has been redesigned. The rear end portion of the pawl 52 is pivotally connected to a radial rib 53 of the front end plate 41 of the hydraulic jack cylinder 14. Such rib 53 is formed with a generally cylindrical projection 54. The central portion of the pawl has a cutout 55 with a forward-extending blind bore 56 in which a compression spring 57 is fitted. Such spring encircles the shank 58 of a pin having an enlarged head 59. The opposite ends of the spring are engaged against the base of the bore 56 and the enlarged head 59 of the pin. The compression spring biases such head outward against the periphery of the general cylindrical projection 54 such that the pawl 52 is positively biased to its downward swung, locking position. The angle of the nose 51 of the pawl is selected such that it will be forced upward automatically by extension of the jack plunger 15. At the same time, the pin enlarged head 59 is forced inward, compressing the spring. The pawl can be manually released conveniently by way of a Bowden cable 60, but the maximum degree of swinging movement of the pawl is limited by the end of the pin shank 58 butting against the base of the blind bore 56. Consequently, the pawl cannot be swung through a large angle such as to a position at which it might become stuck in the released position.

We claim:

1. In a lift having an elongated stationary base frame including front and rear cross members and transversely spaced, longitudinally extending beams connected between said cross members, swingable parallel arms pivotally mounted toward the front and rear ends of the base frame, respectively, an elongated lifting member pivotally connected to the ends of the arms remote from their ends connected to the base frame and extending generally parallel to the base frame, such frame, arms and member forming an approximate parallelogram, and fluid pressure jack means extending generally diagonally of such parallelogram and including a fluid pressure cylinder component and a plunger component movable in such cylinder component for swinging the parallel arms relative to the base frame so as to translate the lifting member, the improvement comprising one of the jack means components being connected to the central portion of the rear cross member approximately midway between the beams, and including two elongated braces having rear end portions connected to the central portion of the rear cross member between the beams at opposite sides of the point of connection of such one jack means component, respectively, each of said braces extending from its point of connection to the rear cross member forward and outward toward the beam at the same side of the base frame, said braces having front end portions connected to the beams, and a compression bar extending between the beams closely adjacent to the front end portions of said braces, whereby force applied to the central portion of the rear cross member by the fluid pressure jack means tending to bow the rear cross member is transmitted as tension of said braces to their connections to the beams and inward bowing of said beams in the area of the front end portions of said braces is resisted by said compression bar.

2. In the lift defined claim 1, the base frame including two brackets mounted, respectively, on the facing sides of the transversely spaced beams, each of said brackets having an inward-opening socket, the compression bar having opposite end portions fitted in said sockets, and the front end portions of the braces being connected to said brackets.

3. In a lift having an elongated stationary base frame including front and rear cross members and transversely spaced, longitudinally extending beams connected between said cross members, swingable parallel arms pivotally mounted toward the front and rear ends of the base frame, respectively, an elongated lifting member pivotally connected to the ends of the arms remote from their ends connected to the base frame and extending generally parallel to the base frame, such frame, arms and member forming an approximate parallelogram, and fluid pressure jack means extending generally diagonally of such parallelogram and including a fluid pressure cylinder component and a plunger component movable in such cylinder component for swinging the parallel arms relative to the base frame so as to translate the lifting member, the improvement comprising the swingable parallel arms including two transversely spaced front arms pivotally connected to the front end portion of the base frame, two front brackets mounted on said two front arms, respectively, and a cross shaft member extending between said front brackets intermediate the ends of said two front arms, the jack means including two fluid pressure jacks each having a fluid pressure cylinder component and a plunger component movable in such cylinder component, one component of each of said jacks being connected to the rear cross member between the beams and the other component of each of said jacks being connected to the cross shaft member between the front brackets, and connecting means separate from the cross shaft member and rigidly interconnected between the plunger components of the jacks at locations spaced longitudinally of the plunger components and between the associated cylinder components and the cross shaft member to assure precisely equal and simultaneous extension and retraction of the plunger components.

4. In the lift defined in claim 3, the same component of each of the jacks being connected to the rear cross member, and the connecting means including a plurality of separate cross members extending between the plunger components to interconnect the plunger components.

* * * * *